US008327566B2

(12) United States Patent
Waggoner

(10) Patent No.: US 8,327,566 B2
(45) **Date of Patent: *Dec. 11, 2012**

(54) WRISTBAND FORM INCLUDING A WRISTBAND AND AN EXTENSION THEREFOR

(75) Inventor: Bryce C. Waggoner, Monroe, OH (US)

(73) Assignee: The Standard Register Company, Dayton, OH (US)

( * ) Notice: Subject to any disclaimer, the term of this patent is extended or adjusted under 35 U.S.C. 154(b) by 35 days.

This patent is subject to a terminal disclaimer.

(21) Appl. No.: 12/826,092

(22) Filed: Jun. 29, 2010

(65) Prior Publication Data

US 2011/0185612 A1 Aug. 4, 2011

Related U.S. Application Data

(63) Continuation of application No. 11/529,653, filed on Sep. 28, 2006, now Pat. No. 7,765,728.

(51) Int. Cl.
*A44C 5/00* (2006.01)

(52) U.S. Cl. ..... 40/633; 283/75

(58) Field of Classification Search ..... 40/633
See application file for complete search history.

(56) References Cited

U.S. PATENT DOCUMENTS

| | | | |
|---|---|---|---|
| 3,848,112 | A | 11/1974 | Weichselbaum et al. |
| 4,122,947 | A | 10/1978 | Falla |
| 5,653,472 | A | 8/1997 | Huddleston et al. |
| 6,016,618 | A | 1/2000 | Attia et al. |
| 6,067,739 | A | 5/2000 | Riley |
| 6,641,048 | B1 | 11/2003 | Schintz et al. |
| 6,836,215 | B1 | 12/2004 | Laurash et al. |
| 7,017,293 | B2 | 3/2006 | Riley |
| 7,017,294 | B2 | 3/2006 | Riley |
| 2004/0060215 | A1 | 4/2004 | Riley |
| 2004/0060216 | A1 | 4/2004 | Riley |
| 2004/0148836 | A1 | 8/2004 | Riley |
| 2004/0244251 | A1 | 12/2004 | Riley |
| 2006/0005441 | A1 | 1/2006 | Riley et al. |
| 2006/0059753 | A1 | 3/2006 | Riley et al. |
| 2006/0059754 | A1 | 3/2006 | Riley |

*Primary Examiner* — James Kramer
*Assistant Examiner* — Shin Kim
(74) *Attorney, Agent, or Firm* — Dinsmore & Shohl LLP

(57) ABSTRACT

A form having a wristband and, optionally, detachable labels, includes a printable face ply and a liner ply. The printable face ply has an upper surface and a lower surface, and a pressure sensitive adhesive on at least a portion of the lower surface. The face ply may include first and second adjacent portions, with the first portion of the face ply die cut to form a detachable wristband having first and second ends and an upper and a lower surface, with pressure sensitive adhesive on the lower surface of the detachable wristband adjacent the first and second ends, and with the second portion of the face ply die cut to form the series of detachable labels. The first portion of the face ply is also die cut to form an extender band having first and second ends and an upper and a lower surface, with pressure sensitive adhesive on the lower surface of the extender band adjacent the first and second ends. One of the extender band and the wristband defines an opening through which one of the first and second ends of the other of the extender band and the wristband can extend. As a result, the wristband and the extender band can be secured together by adhesive at their respective overlapping ends to increase effectively the length of the wristband. Variations in construction include providing adhesive at fewer than all of the wristband and extender band ends, and only having a single portion face ply.

29 Claims, 4 Drawing Sheets

WRISTBAND FORM INCLUDING A WRISTBAND AND AN EXTENSION THEREFOR

CROSS-REFERENCE TO RELATED APPLICATIONS

This application is a continuation of U.S. patent application Ser. No. 11/529,653 filed Sep. 28, 2006 now U.S. Pat. No. 7,765,728.

STATEMENT REGARDING FEDERALLY SPONSORED RESEARCH OR DEVELOPMENT

Not applicable.

BACKGROUND OF THE INVENTION

The present invention relates to a printable form, and more particularly, to a form having a wristband accompanied by an extender band. The printable form may also include a plurality of detachable labels. The form, bands and labels may be printed with information in a single pass through a printer.

It is a common practice in hospitals to identify patients with a bracelet or band containing the patient's name or other identification information. The band is generally secured around the wrist of a patient so that hospital personnel can properly identify the patient during his stay. While this has been an effective method of identifying patients, many hospitals have had problems correlating patient information on specimens, drug prescriptions, physician's orders, and the like. Clerical errors in the handling of such routine matters can result in the dispensing of the wrong medicine or treatment to a patient. Additionally, creating the wristband for the patient at the time that the patient is admitted to the hospital took more time than was desired.

Several attempts were made to improve the correlation of patient information to various hospital forms. For example, Falla, U.S. Pat. No. 4,122,947 teaches a pre-packaged patient identification kit which includes a wristband, a specimen container, and a label for attachment to a patient's record, all of which are provided with identical patient information. Weichselbaum et el, U.S. Pat. No. 3,848,112, teaches a patient identification system in which an identification bracelet secured to a patient is used to dispense a series of tags which are magnetically coded with patient information.

Huddleston et al, U.S. Pat. No. 5,653,472 discloses a significant improvement in patient wristbands. Huddleston teaches a multi-ply, printable form, that includes a wristband and a plurality of removable labels. The wristband and the labels all carry adhesive on their back surfaces, permitting them to be secured to the patient's wrist in the case of the wristband, or attached to a patent chart, to reports, to specimen containers, and the like in the case of the labels. While the Huddleston form was a significant improvement, the wristband of Huddleston et al was limited in length and therefore might not be usable with a patient having an unusually large wrist, or when the band was to be applied to a patient's ankle or leg.

Riley, U.S. Pat. No. 7,017,294 recognized this problem and addressed it by including an extender band on a wristband form. The extender band of Riley is made from the same two plies of material which make up the principle wristband. The extender band of Riley has a fold over or "clamshell" portion at one end of the extender band, carrying an adhesive coating. The "clamshell portion is folded over the end of the principal wristband and adhesively secured to both the upper surface and the lower surface of the principal wristband. With an extender band, the wristband is not limited in length to the overall length of the form on which the wristband is carried. The combination of the wristband and the extender band can be used on larger patients. It will be appreciated, however, that the Riley wristband and extender band are somewhat complicated in construction, requiring the application of both adhesive and release coating in patterns, and requiring that both the face sheet and release sheet be die cut. Further, the use of the wristband and extender band of Riley may be more complicated than desired.

Accordingly, there is a need in for an identification system of simple construction which includes a wristband, and an extender band, and, optionally, an accompanying series of labels or tags, which can be efficiently provided with correlating identification information, and which can be easily dispensed and used for a variety of applications.

SUMMARY OF THE INVENTION

This need is met by a form constructed in accordance with the present invention, having a wristband and, optionally, detachable labels. The form has a printable face ply having an upper surface and a lower surface and a pressure sensitive adhesive is provided on at least a portion of the lower surface. The face ply includes first and second adjacent portions. The first portion of the face ply is die cut to form a detachable wristband having first and second ends and an upper and a lower surface. A pressure sensitive adhesive is provided on the lower surface of the detachable wristband adjacent the first and second ends. The first portion of the face ply is die cut to form an extender band having first and second ends and an upper and a lower surface, with pressure sensitive adhesive on the lower surface of the extender band adjacent the first and second ends. One of the extender band and the wristband defines an opening through which one of the first and second ends of the other of said extender band and the wristband can extend. As a result, the wristband and the extender band can be secured together by adhesive at their respective overlapping ends to increase effectively the length of the wristband. The second portion of the face ply may be die cut to form a series of detachable labels. A liner ply has an upper surface and a lower surface. The liner ply includes a release coating on at least a portion of the upper surface thereof, and is adhered to the pressure sensitive adhesive on the lower surface of the face ply.

The first and second portions of the face ply may be separate sheets. One of the portions of the face ply may comprise a polymer sheet and the other of the portions of the face ply may comprise a paper sheet. The face ply may comprise paper or polyester. The upper surface of the face ply may include printed indicia thereon. The liner ply may be coextensive with the face ply. The wristband may have a narrowed portion at the first end, sized to extend through the opening of the extender band. The opening may be a substantially rectangular opening or, alternatively, a narrow slit. The second portion of the face ply may include a pressure sensitive adhesive on the lower surface of the ply in the area of the labels. The face ply may further comprise relatively small, color-coded labels that may be applied to the wristband to designate the condition of the patient.

The form may be one of a plurality of such forms arranged in an extended, continuous web of forms defined by intervening lines of weakness. The web may be zig-zag folded into a stack of forms, or the web may be rolled into a roll of forms.

In an alternative construction, the form may have only a single portion printable face ply, and may not include labels die cut from the face ply.

In a further alternative construction, pressure sensitive adhesive may be provided on the lower surface of the detachable wristband and the extender band adjacent one of the respective first and second ends of the wristband and said extender band. The ends of the wristband and the extender band not having adhesive may be connected to the balance of the face sheet by a plurality of ties. The wristband and the extender band may be of differing widths with the narrower of the two extending through an opening in the other.

Accordingly, it is an object of the present invention to provide an improved wristband form that includes an extender band as well as a wristband, in which the construction of the bands and the use of the bands are simplified.

DETAILED DESCRIPTION OF THE PREFERRED EMBODIMENTS

Figure 1:
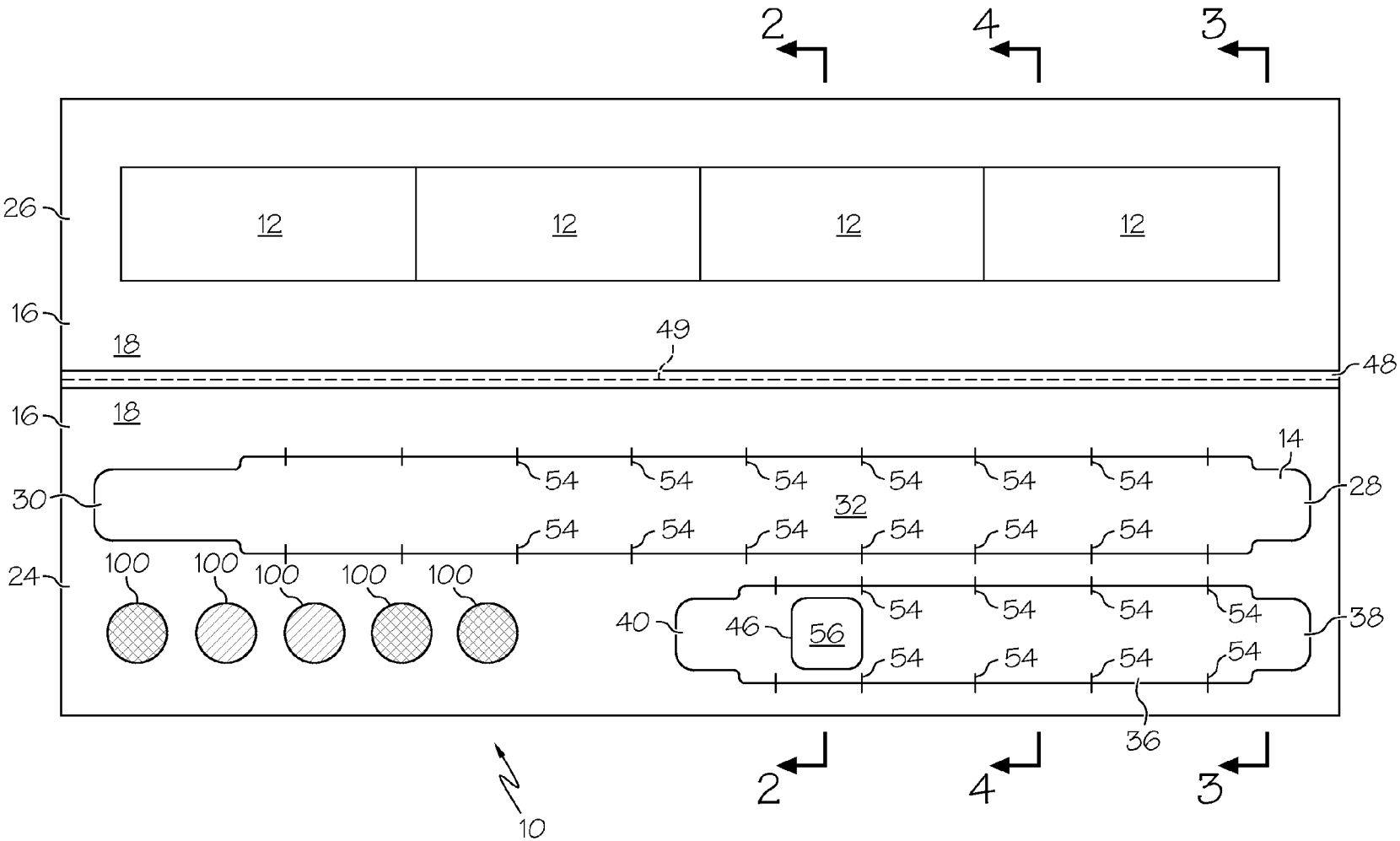
FIG. 1 is a plan view of a form having detachable labels, a wristband, and an extender band according to the present invention.
Figure 2:
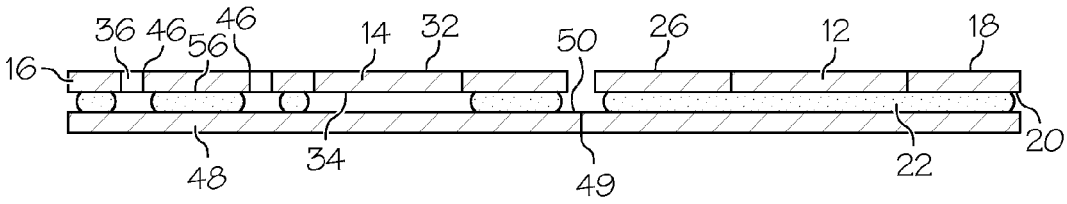
FIG. 2 is a sectional view of the form of FIG. 1, taken generally along line 2-2 in FIG. 1.
Figure 3:
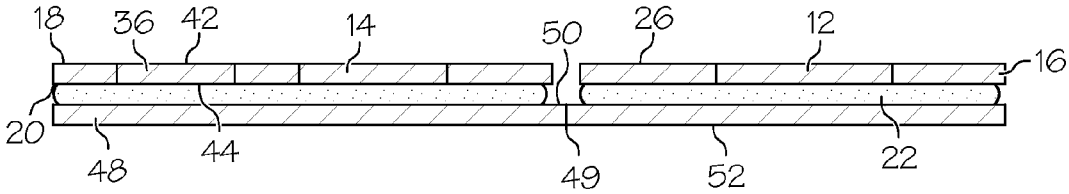
FIG. 3 is a sectional view of the form of FIG. 1, taken generally along line 3-3 in FIG. 1.

Reference is made to FIGS. 1-4 of the drawings which show a form 10 having detachable labels 12 and a wristband 14 constructed according to one embodiment of the present invention. The form has a printable face ply 16 having an upper surface 18 and a lower surface 20, and further including a pressure sensitive adhesive 22 on at least a portion of the lower surface 20. The face ply 16 includes first and second adjacent portions. The first portion 24 of the face ply 16 is die cut to form the detachable wristband 14 having first and second ends 28 and 30 and an upper and a lower surface 32 and 34. As illustrated in FIG. 3, the lower surface 34 of the wristband 14 carries pressure sensitive adhesive adjacent the first end 28. In this embodiment, the lower surface 34 of the wristband 14 also carries pressure sensitive adhesive adjacent the second end 30.

Figure 5:
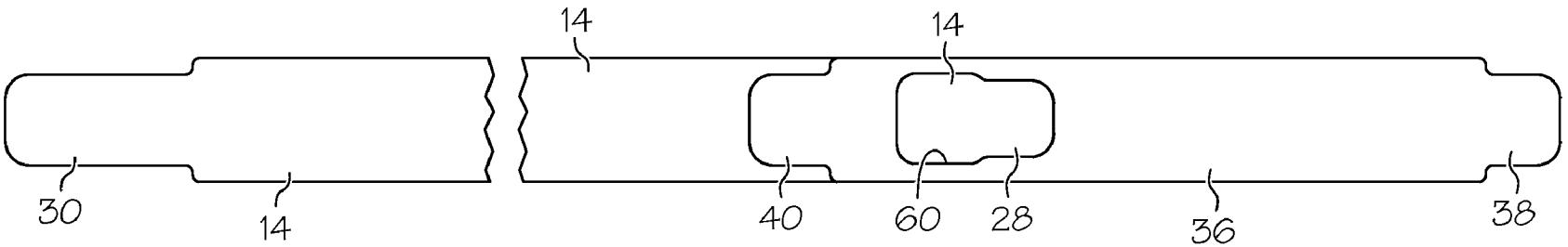
FIG. 5 shows the manner in which the wristband and extender band of FIGS. 1-4 may be secured together to effect an extension of the wristband.

The first portion 24 of the face ply 16 is die cut to form an extender band 36 having first and second ends 38 and 40, an upper surface 42 and a lower surface 44. As will be noted in FIG. 3, the lower surface 44 of the extender band 36 carries pressure sensitive adhesive 22 adjacent the first end 38. In this embodiment, the lower surface 44 of the extender band 36 also carries pressure sensitive adhesive 22 adjacent the second end 40. One of the extender band 36 and the wristband 14 defines an opening through which one of the first and second ends of the other of the extender band 36 and the wristband 14 can extend. In this embodiment, an opening is defined in the extender band 36 by rectangular die cut 46. In an alternative embodiment, the opening may be defined in the wristband 14. As discussed more full below and as illustrated in FIG. 5, the wristband 14 and the extender band 36 of this embodiment can be secured together by adhesive 22 at their respective overlapping ends 28 and 40 to increase effectively the length of the wristband 14.

Figure 4:
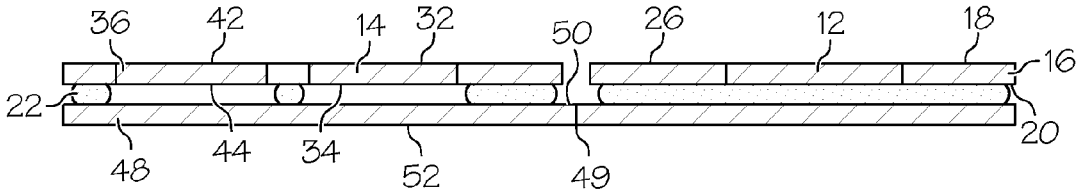
FIG. 4 is a sectional view of the form of FIG. 1, taken generally along line 4-4 in FIG. 1.

The second portion 26 of the face ply 16 is die cut to form a series of detachable labels 12. As shown in FIGS. 2-4, this second portion 26 of the face ply 16 includes pressure sensitive adhesive 22 on the lower surface 20 in the area of the labels 12.

The form 10 further includes a liner ply 48 having an upper surface 50 and a lower surface 52. The liner ply 48 includes a release coating on at least a portion of the upper surface 50, and is adhered to the pressure sensitive adhesive 22 on the lower surface 20 of the face ply 16. The liner ply 48 has a perforation line 49 which permits the parts of the form 10 to be separated in use, if desired.

The first and second portions 24 and 26 of the face ply 16 are shown in the drawings as separate sheets. It will be appreciated, however, that only a single sheet may be used for the face ply. When the first and second portions 24 and 26 are separate sheets, they may be made of differing materials so that an optimum material may be selected for use as a wristband 14 and extender band 36, and other materials selected for the labels 12. For example, the portion 24 may be made of a polymer material and the portion 26 may be made of paper.

As will be noted in FIG. 4, the lower surfaces 34 and 44 of the wristband 14 and the extender band 36 do not carry a layer of adhesive, since these are the surfaces that will be in contact with the skin of the wristband wearer. In order to keep these sections of the wristband 14 and the extender band 36 in place on the form, the die cuts in the upper ply 16 are interrupted by a series of ties, illustrated schematically at 54. Note in FIG. 2, that the die cut 46 defines a patch 56 of the face ply 16 which carries adhesive 22. This is because the patch 56 is intended to remain on the liner ply 48 when the extender band 36 is removed from the form 10. Alternatively, the patch 56 may be removed during manufacturing of the form, with the die cut 46 defining an opening 60 in extender band 36 of the finished form 10.

It will be appreciated that form 10 is substantially uniform in thickness and may be printed in a single printing pass through a conventional printer, such as a laser printer. Other printing technologies contemplated include but are not limited to thermal, thermal transfer, and ink jet printing devices. Depending on the printer used, form 10 may be manufactured as a cut sheet form, a continuous fan-fold form, or a continuous form stored in a roll of such forms.

During this single pass, the form 10, the wristband 14, the extender band 36 and any or all of the labels 12 and 100 can be printed, as desired.

When the wristband 14 is to be attached to the wearer, after the form 10 is printed as desired, the wristband 14 is removed from the form. It is then wrapped around the wearer's wrist, and one end is adhesively attached to the lower surface 34 of the wristband at an appropriate point along its length, depend upon the wearer's wrist size. The other end of the wristband is then wrapped around the wrist and the adhesive on this other end then secures it to the upper surface 32 of the wristband.

It sometimes happens that the wearer's wrist may be too large for the wristband 14 to be used. In other instances, it may be desirable to apply the wristband 14 to the leg of the wearer, also requiring a larger band. In either case, the present invention contemplates the extension of the wristband 14 by use of the extender band 36. The manner of attachment of the extender band 36 and the wristband 14 is illustrated in FIG. 5. As will be noted, the opening 60 is defined by the extender band 36. The wristband 36 has a narrowed portion adjacent end 28 which is sized to extend through the opening 60. The adhesive on the lower surfaces of the wristband and the extender band adjacent their overlapping ends the adhesively secures them together as shown in FIG. 5.

Figure 8:
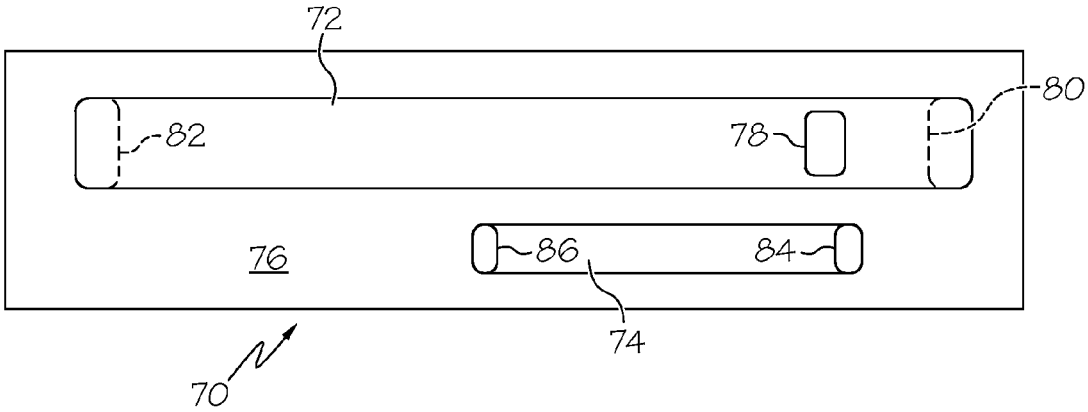
FIG. 8 is a plan view of a form constructed according to an alternate embodiment of the present invention, and having a wristband and an extender band, but not including detachable labels.

It will be noted that both the wristband 14 and the extender band 36 have narrowed portions adjacent their respective ends. It should be appreciated, however, that this may not be necessary. In the embodiment of the invention shown if FIG. 8, the form 70 includes a wristband 72 and an extender band 74 which are die cut from the top ply 76. Note that in this embodiment, the wristband 72 includes has a die cut 78 that defines the opening used in connecting the two bands. The areas 80 and 82 at the ends of the wristband 72 and 84 and 86 at the ends of the extender band 74, indicated by broken lines, represent areas that carry an adhesive coating on the lower surfaces of the wristband 72 and extender band 74 in this embodiment. It will be appreciated, however that the area 80 may be reduced in size so that it is no wider than the width of the extender band 74 so that the adhesive is kept out of contact with the skin of the wearer when the extender band is used. It will be appreciated that while the embodiment of FIG. 8 is shown with the extender band 74 narrower than the wristband 72, the opposite may also be used, i.e., the wristband 72 may be narrower than the extender band 74. With such an arrangement, the opening to facilitate attachment of the extender band to the wristband is defined in the extender band such that the wristband can extend through the opening when the two bands are attached.

FIGS. 1-5, 7 and 8 show the opening in the wristband or the extender band as generally rectangular in shape. Any other shape that functions for the intended purpose, such as for example a narrow slit, may be used, as well.

It should be understood that forms constructed according to the present invention, such as shown in FIGS. 1 and 8, may be provided to a printer for printing as a stack of separate sheets. Alternatively, a plurality of such forms may be arranged in an extended, continuous web of forms defined by intervening lines of weakness. The web may be zig-zag folded into a stack of forms, or it may be arranged in a roll of forms.

The form of the present invention may optionally further include a plurality of relatively small, color-coded labels that can be applied to the wristband to designate the condition of the patient wearing the wristband, or to alert others to other information.

Figure 6:
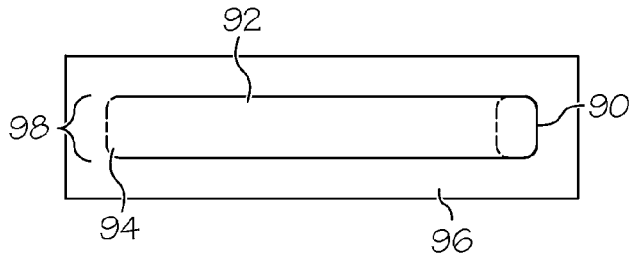
FIG. 6 is a plan view of an alternate embodiment of the extender band of the present invention.
Figure 7:
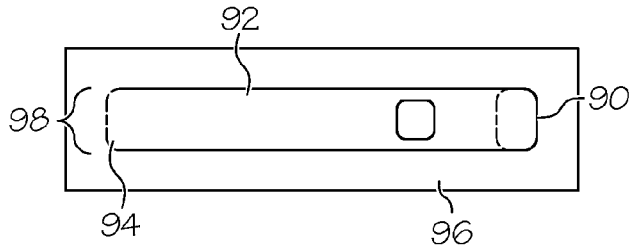
FIG. 7. is a plan view of an another alternate embodiment of the extender band of the present invention.

The embodiments shown in FIGS. 1-5 and 8 have adhesive coatings on the lower surfaces of both the wristband and the extender band adjacent both ends of the bands. This may not be required in all instances, however. Rather, it may be desirable to provide adhesive adjacent only one end of the bands. This will, of course, depend upon the way in which the wristband is to be used. If only one area of adhesive attachment of the band ends is sufficient, then only one end 90 of the extender band 92 need carry any adhesive and an arrangement as shown in FIG. 6 or 7 may be adopted. It will be understood that FIGS. 6 and 7 do not show entire forms. Rather only the portions of the forms that carry the extender bands 90 are illustrated. Note that there is pressure sensitive adhesive on the lower surface of the extender bands 92 adjacent one end 90 of the extender band 92, and that the other end 94 extender band 92 is connected to the balance of the face ply 96 by a plurality of ties 98. Although only the extender band 92 is shown in FIGS. 6 and 7, it will be appreciated that a similar arrangement may be provided for the wristband in which one end of the wristband carries adhesive that holds it in position on the release ply, and the other end of the wristband is attached to the face ply by a plurality of ties.

Other variations and modifications may be made to the form 10. Other labels may be included as a part of the form. For example, face ply 16 may further comprise a plurality of relatively small, color-coded labels 100 that can be applied to the wristband 14 to designate the condition of the wearer.

Although the present invention has been described in terms of the presently preferred embodiments, it is to be understood that the disclosure is not to be interpreted as limiting. Accordingly, it is intended that the appended claims be interpreted as covering all alterations and modifications as fall within the true spirit and scope of the invention.

What is claimed is:

1. A form having detachable labels and a wristband, comprising:

a printable face ply having an upper surface and a lower surface and having a pressure sensitive adhesive on at least a portion of the lower surface, the face ply including first and second adjacent portions, where the first portion of the face ply is die cut to form a detachable wristband having first and second ends and an upper and a lower surface, with pressure sensitive adhesive on the lower surface of the detachable wristband adjacent the first and second ends, where the first portion of the face ply is die cut to form an extender band having first and second ends and an upper and a lower surface, with pressure sensitive adhesive on the lower surface of the extender band adjacent the first and second ends, said wristband defining an opening through which one of the first and second ends of said extender band can extend, whereby the wristband and the extender band can be secured together by adhesive at their respective overlapping ends to increase effectively the length of the wristband, and where the second portion of the face ply is die cut to form a series of detachable labels; and a liner ply having an upper surface and a lower surface, the liner ply including a release coating on at least a portion of the upper surface thereof, and being adhered to the pressure sensitive adhesive on the lower surface of the face ply.

2. The form of claim 1 wherein the first and second portions of the face ply are separate sheets.

3. The form of claim 2 wherein the one of the portions of the face ply comprises a polymer sheet and the other of the portions of the face ply comprises a paper sheet.

4. The form of claim 1 wherein the extender band is narrower than said wristband such that said extender band can extend through said opening.

5. The form of claim 1 in which one of said wristband and said extender band has a narrowed portion at the first end thereof, and in which the narrowed portion is sized to extend through the opening.

6. The form of claim 1, in which the opening is a substantially rectangular opening.

7. The form of claim 1, in which the opening is a narrow slit.

8. The form of claim 1 wherein the second portion of the face ply includes a pressure sensitive adhesive on the lower surface of the face ply in the area of the labels.

9. The form of claim 1 in which the form is a cut sheet form.

10. The form of claim 1 in which the form is one of a plurality of such forms arranged in an extended, continuous web of forms defined by intervening lines of weakness.

11. The form of claim 10 wherein the web is zig-zag folded into a stack of forms.

12. The form of claim 10 wherein the web is rolled into a roll of forms.

13. The form of claim 1 in which the face ply further comprises relatively small, color-coded labels that may be applied to the wristband.

14. A form having a wristband, comprising:

a printable face ply having an upper surface and a lower surface and having a pressure sensitive adhesive on at least a portion of the lower surface, where the face ply is die cut to form a detachable wristband having first and second ends and an upper and a lower surface, with pressure sensitive adhesive on the lower surface of the detachable wristband adjacent the first and second ends, where the face ply is die cut to form an extender band having first and second ends and an upper and a lower surface, with pressure sensitive adhesive on the lower surface of the extender band adjacent the first and second ends, said wristband defining an opening through which one of the first and second ends of said extender band can extend, whereby the wristband and the extender band can be secured together by adhesive at their respective overlapping ends to increase effectively the length of the wristband, and a liner ply having an upper surface and a lower surface, the liner ply including a release coating on at least a portion of the upper surface thereof, and being adhered to the pressure sensitive adhesive on the lower surface of the face ply.

15. The form of claim 14 wherein the extender band is narrower than said wristband such that said extender band can extend through said opening.

16. The form of claim 14, in which the opening is a substantially rectangular opening.

17. The form of claim 14, in which the opening is a narrow slit.

18. The form of claim 14 in which the form is a cut sheet form.

19. The form of claim 14 in which the form is one of a plurality of such forms arranged in an extended, continuous web of forms defined by intervening lines of weakness.

20. The form of claim 19 wherein the web is zig-zag folded into a stack of forms.

21. The form of claim 19 wherein the web is rolled into a roll of forms.

22. The form of claim 14 in which the face ply further comprises relatively small, color-coded labels that may be applied to the wristband.

23. A form having a wristband, comprising:

a printable face ply having an upper surface and a lower surface and having a pressure sensitive adhesive on at least a portion of the lower surface, where the face ply is die cut to form a detachable wristband having first and second ends and an upper and a lower surface, with pressure sensitive adhesive on the lower surface of the detachable wristband adjacent one of said first and second ends of said wristband, where the face ply is die cut to form an extender band having first and second ends and an upper and a lower surface, with pressure sensitive adhesive on the lower surface of the extender band adjacent one of said first and second ends of said extender band, said wristband defining an opening through which one of the first and second ends of said wristband can extend, whereby the wristband and the extender band can be secured together by adhesive at their respective overlapping ends to increase effectively the length of the wristband, and a liner ply having an upper surface and a lower surface, the liner ply including a release coating on at least a portion of the upper surface thereof, and being adhered to the pressure sensitive adhesive on the lower surface of the face ply.

24. The form of claim 23, in which the form is a cut sheet form.

25. The form of claim 23, in which the form is one of a plurality of such forms arranged in an extended, continuous web of forms defined by intervening lines of weakness.

26. The form of claim 25, in which the web is zig-zag folded into a stack of forms.

27. The form of claim 23 in which there is pressure sensitive adhesive on the lower surface of the detachable wristband adjacent one of said first and second ends of said wristband and in which the other of said first and second ends of said wristband is connected to the balance of said face ply by a plurality of ties.

28. The form of claim 23 in which there is pressure sensitive adhesive on the lower surface of the extender band adjacent one of said first and second ends of said extender band and in which the other of said first and second ends of said extender band is connected to the balance of said face ply by a plurality of ties.

29. The form of claim 23 wherein the extender band is narrower than said wristband such that said extender band can extend through said opening.

* * * * *